United States Patent [19]

Erasmus

[11] 4,059,111

[45] Nov. 22, 1977

[54] APPARATUS AND METHOD FOR ORAL DOSING

[75] Inventor: Frans P. G. Erasmus, Kempton Park, South Africa

[73] Assignee: Smith Kline & French (Proprietary) Limited, Isando, South Africa

[21] Appl. No.: 689,754

[22] Filed: May 25, 1976

[30] Foreign Application Priority Data

May 28, 1975 South Africa ..... 75/3459

[51] Int. Cl.[2] ..... A61D 7/00

[52] U.S. Cl. ..... 128/223

[58] Field of Search ..... 128/223, 222

[56] References Cited

U.S. PATENT DOCUMENTS

| | | | |
|---|---|---|---|
| 874,239 | 12/1907 | Ratliff | 128/223 |
| 907,886 | 12/1908 | Riesland | 128/223 |
| 969,482 | 9/1910 | Jones | 128/223 |
| 1,238,390 | 8/1917 | Crittenden | 128/223 |

*Primary Examiner*—John D. Yasko

*Attorney, Agent, or Firm*—Joseph A. Marlino; Richard D. Foggio; William H. Edgerton

[57] ABSTRACT

A method and apparatus for the oral dosing of animals, such as cattle, which comprises a substantially U-shaped conduit adapted to be passed into the mouth of the animal so that the leading end points in the direction of the animal's throat and the rear end projects from the side of the animal's mouth. A suitable substance is passed via the conduit into the animal's mouth.

14 Claims, 1 Drawing Figure

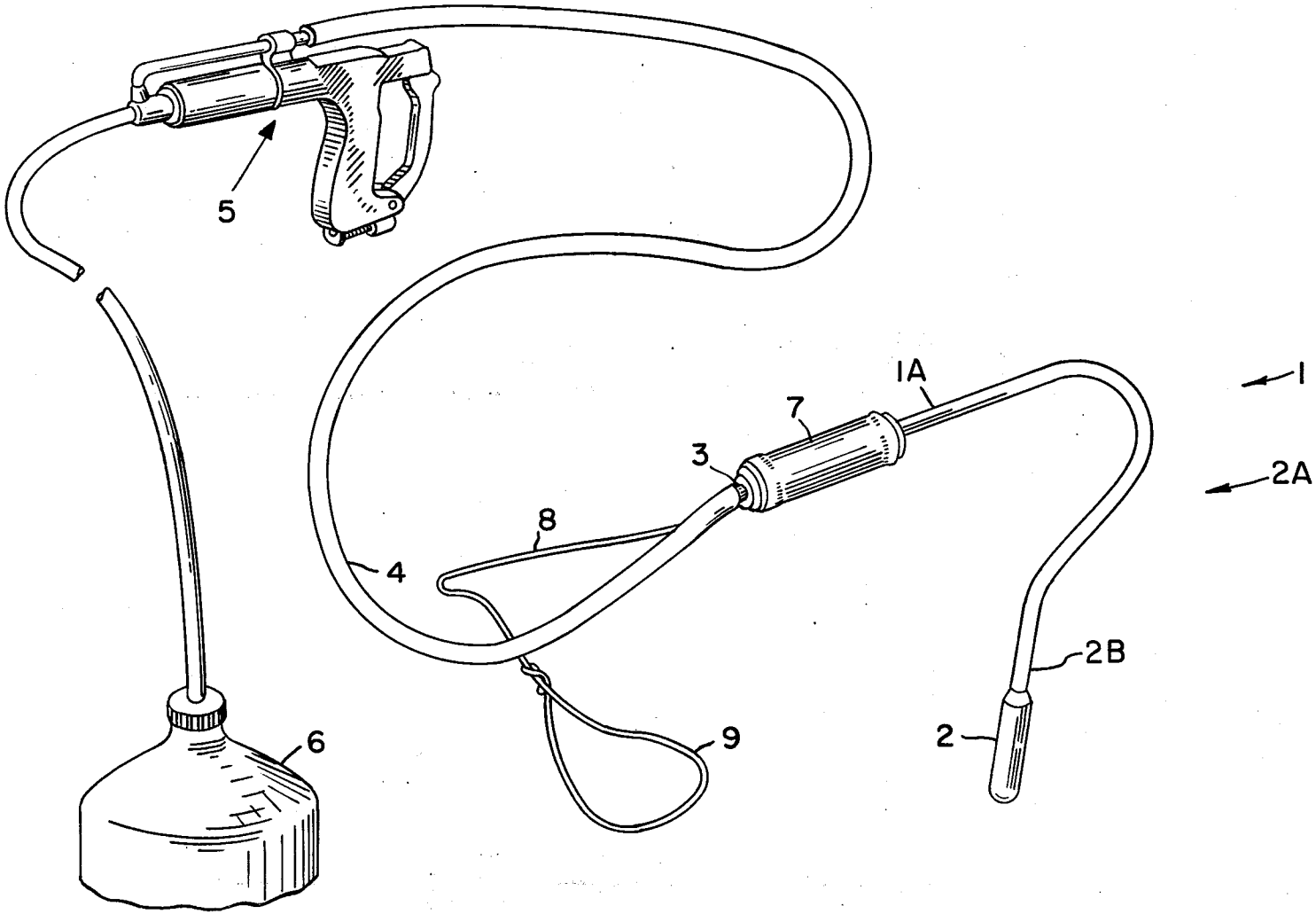
1
2A
2B
2
1A
7
3
9
8
4
5
6

APPARATUS AND METHOD FOR ORAL DOSING

This invention relates to oral dosing and then more particularly the dosing of animals with medicines and the like.

Animals are usually dosed with medicines and the like either orally or intravenously.

Although an oral dosing may sometimes be the appropriate treatment in view of the type and/or nature of the particular medicament involved, the difficulties associated with the physical dosing of such animals, especially the larger types such as cattle for example, may encourage the employment of the less appropriate intravenous dosing.

It is accordingly an object of this invention to provide a method of oral dosing and apparatus suitable therefor which the applicant believes will have advantages over the known arrangements.

According to the invention a method for the oral dosing of an animal with a substance such as a medicament or the like includes the steps of locating a substantially U-shaped conduit in the mouth of the animal for the leading end thereof to point in the direction of the animal's throat and the other end to project from the side of the mouth of the animal; and passing the substance via the conduit into the mouth of the animal.

Applicant has found that such an arrangement not only ensures that most of the dosing substances does in fact pass down the animal's throat but also that the shape of the tube allows for the person administering the substance to be in a position next to the animal which of course facilitates handling of the animal during the dosing operation.

The substance may be passed to the conduit in any convenient manner.

Thus, for example, the substances may be passed from a container or the like via a pump or the like to the conduit.

Preferably the conduit passes between the lips of the animal at a position towards the back of its mouth behind the teeth.

This arrangement not only ensures that the animal's mouth can be in a substantially closed position during the dosing operation so to minimize the possibility of the dosing substance escaping from the mouth but also reduces the possibility of the conduit being damaged by the animal's teeth during the dosing operation.

The conduit may be located in the aforesaid position by pulling the lips of the animal away from the front of its mouth until its back teeth are exposed and then passing the leading end of the conduit behind the teeth into the mouth of the animal.

The conduit is preferably connected to the pump or the like through a substantially flexible tube or the like.

Any movement of the head of the animal with the conduit in its mouth may hence be taken up by the flexible tube.

Further according to the invention apparatus suitable for use in the oral dosage of an animal with a substance such as a medicament or the like includes a substantially U-shaped conduit adapted to be passed into the mouth of the animal so that its leading end points in the direction of the animal's throat and its other end projects from the side of the animal's mouth; and means for passing the substance via the conduit into the mouth of the animal.

Further according to the invention the end of the conduit projecting from the mouth of the animal is adapted for connection to a tube or the like through which the substance may be passed from a container or the like to the conduit.

Further according to the invention the conduit is connected to a handle or the like.

Not only does such a handle facilitate handling of the apparatus itself but also the handling of the animal by means of the apparatus.

Preferably the handle has one end of a flexible element such as for example a length of rope or the like secured to it, the other end of the element including a holding formation or the like.

With this arrangement the person carrying out the dosing operation may hence hold on to the apparatus by means of the rope even after the handle has slipped from his hand say as a result of movement of the animal, etc.

The invention will now be further described by way of example with reference to the enclosed drawing which is a perspective view of oral administering apparatus according to the invention.

In this embodiment of the invention a substantially rigid U-shaped conduit 1, having a leading end 2, has its rear end 3 connected to a flexible tube 4 leading via a hand operated pump 5 to a container 6. Conduit 1 has a leg 1A ending at rear end 3 and a leg 2A with an offset leading portion 2B which includes leading end 2 which points in the direction of the animal's throat. Leg 1A points in the direction of the animal's rear end. The offset leading portion 2B is offset in the direction away from leg 1A.

A handle 7 is provided on conduit 1 in the vicinity of its rear end 3.

A length of rope or the like 8, of which one end is tied into a loop 9, is secured to handle 7.

In operation the apparatus is set up as shown and container 6 provided with the dosing substance. The device is held by handle 7 with loop 9 of rope 8 passing over the hand of the operator.

The lips of the animal to be dosed are pulled back and leading end 2 of conduit 1 passed behind the back teeth of the animal into its mouth until leading end 2 extends substantially into the throat of the animal.

Should the animal at this stage move its head about, as is customary for them to do, flexible tube 4 will allow such movement. If necessary the operator may even allow handle 7 to slip from his hand while holding onto rope 8.

The required amount of substance from container 6 may then be passed by hand operated pump 5 via tube 4 and conduit 1 into the mouth and down the throat of the animal.

It will be appreciated that with the arrangement according to the invention it will be possible to ensure that substantially all of the dosing substance will pass into the animal's throat. Also, since the operator may stand next to the animal during the dosing operation and may also to a certain extent control the movement of the animal by means of the device located in its mouth, the carrying out of the operation may be facilitated.

It will be further appreciated that with a method and means according to the invention many variations in detail are possible without departing from the scope of the appended claims.

Thus, for example, rear end 3 of conduit 1 may be connected directly on to the discharge end of pump 5. This modified arrangement of the apparatus may for example be employed for dosing smaller animals such as sheep and the like in the same manner as that set out above.

We claim:

1. A method for the oral dosing of an animal with a suitable substance including the steps of locating a substantially rigid U-shaped conduit having an offset leg portion in the mouth of the animal so that the leading end thereof points in the direction of the animal's throat and the rear end thereof projects from the side of the animal's mouth and said offset leg portion points in the direction of the animal's rear to allow for the person administering the dose to be in a position next to the animal to facilitate handling the animal; and passing the substance via the conduit into the animal's mouth.

2. The method of claim 1 wherein the substance is passed by means of a pump or the like via the conduit into the animal's mouth.

3. The method of claim 1 wherein the conduit is made to pass between the animal's lips at a position towards the back of its mouth behind its teeth.

4. Apparatus suitable for use in the oral dosing of an animal with a suitable substance including a substantially rigid U-shaped conduit having an offset leg portion which is adapted to be passed into the mouth of the animal so that its leading end points in the direction of the animal's throat and its rear end projects from the side of the animal's mouth and said offset leg portion points in the direction of the animal's rear to allow for the person administering the dose to be in a position next to the animal to facilitate handling the animal, and means adapted to pass the substance via the conduit into the mouth of the animal.

5. The apparatus of claim 4 wherein the means comprises a pump connected through a flexible tube to the rear end of the conduit.

6. The apparatus of claim 4 wherein the rear end of the conduit includes a handle or the like.

7. The apparatus of claim 6 wherein the handle has one end of a flexible element secured to it, the other end of the element including a holding formation or the like.

8. Apparatus suitable for use in the oral dosing of an animal with a suitable substance including a substantially rigid U-shaped conduit adapted to be passed into the mouth of the animal and having a first leg with an offset leading portion the end of which points in the direction of the animal's throat and having a second leg projecting from the side of the animal's mouth and pointing in the direction of the animal's rear to allow for the person administering the dose to be in a position next to the animal to facilitate handling the animal, said leading portion of the first leg being offset in the direction away from the second leg, and means adapted to pass the substance via the conduit into the mouth of the animal.

9. The apparatus of claim 8 wherein the means comprises a pump connected through a flexible tube to the rear end of the conduit.

10. The apparatus of claim 9 wherein the rear end of the conduit includes a handle or the like.

11. The apparatus of claim 10 wherein the handle has one end of a flexible element secured to it, the other end of the element including a holding formation.

12. A method for the oral dosing of an animal with a suitable substance including the steps of locating a substantially rigid U-shaped conduit in the mouth of the animal so that an offset leading portion of a first leg points in the direction of the animal's throat and a second leg projects from the side of the animal's mouth and points in the direction of the animal's rear to allow for the person administering the dose to be in a position next to the animal to facilitate handling the animal, said leading portion of the first leg being offset in the direction away from the second leg, and passing the substance via the conduit into the animal's mouth.

13. The method of claim 12 wherein the substance is passed by means of a pump or the like via the conduit into the animal's mouth.

14. The method of claim 13 wherein the conduit is made to pass between the animal's lips at a position towards the back of its mouth behind its teeth.

* * * * *